United States Patent [19]

Kristensson

[11] 4,039,223

[45] Aug. 2, 1977

[54] CHAIR HAVING A TILTABLE BACK-REST AND TWO PIVOTAL LEG SUPPORTS

[75] Inventor: Nils Lars Ove Kristensson, Stockholm, Sweden

[73] Assignee: Landstingens Inkopscentral Lic, Ekonomisk Forening, Solna, Sweden

[21] Appl. No.: 622,650

[22] Filed: Oct. 15, 1975

[30] Foreign Application Priority Data

Oct. 15, 1974 Sweden ..... 7412981

[51] Int. Cl.[2] ..... A47C 1/02

[52] U.S. Cl. ..... 297/90; 297/423

[58] Field of Search ..... 297/90, 91, 68, 71, 297/423, DIG. 4, 85, 88, 89, 83, 429, 430, 433

[56] References Cited

U.S. PATENT DOCUMENTS

| | | | |
|---|---|---|---|
| 1,534,272 | 4/1925 | Koken | 297/90 |
| 3,495,869 | 2/1970 | Ingemansson | 297/91 X |
| 3,858,938 | 1/1975 | Kristensson | 297/68 |

FOREIGN PATENT DOCUMENTS

| | | | |
|---|---|---|---|
| 341,252 | 6/1904 | France | 297/91 |
| 122,691 | 7/1901 | Germany | 297/90 |

*Primary Examiner*—James T. McCall
*Attorney, Agent, or Firm*—Young & Thompson

[57] ABSTRACT

A chair, particularly a wheel-chair, having a spring biased tiltable back-rest and two pivotal leg supports including each a foot rest. The length of the leg supports from their pivot axis is automatically extended when the leg supports are swung to their horizontal position. The leg supports are provided with simple adjusting means to enable continuous adjustment of the length of the leg supports and with simple releasable means to lock and release the leg supports respectively in any angular or horizontal position.

3 Claims, 9 Drawing Figures

CHAIR HAVING A TILTABLE BACK-REST AND TWO PIVOTAL LEG SUPPORTS

The present invention relates to chairs, particularly wheel-chairs, of the general kind disclosed in U.S. Pat. No. 3,858,938. A known chair of this type is diagrammatically shown in FIGS. 1 and 2 in the enclosed drawings, to facilitate the understanding of the basic principles of the chairs under consideration.

In the following specification, the disclosure is limited to one of the two leg supports provided beside each other at the front end of the chair.

FIG. 1 shows the chair adjusted for a normal sitting position, whereas in FIG. 2 the chair has been adjusted for a lying position on the substantially horizontal back-rest and substantially horizontal leg support.

The frame 10 of the known chair is carried by front wheels 11 and rear wheels 11*a* and supports a seat frame 13. A back rest frame 12 may be tilted from a vertical position in FIG. 1 to a substantially horizontal position in FIG. 2 and locked in any of these positions or any predetermined angular position therebetween in a manner known per se, for instance as disclosed in the above U.S. patent.

Each leg support 14 can be moved from a substantially vertical position to a substantially horizontal position and be locked in any predetermined angular position or in the horizontal position in a manner known per se, for instance as disclosed in the above U.S. patent.

Each leg support 14 includes a foot rest 15. The length of the leg support between its pivot center 16 at the front end of the seat frame and the foot rest 15 is adjustable and is locked to a fixed vertical length by means of a locking screw 17 to suit the person sitting in the chair.

The leg support is carried by a pair of parallelogram links 18,19 connected to a carrier arm 20 which is pivotally mounted at the pivot 16. The link 19 is extended with a portion 19*a* and has its free end connected to a control rod 21 which is slidable in a connecting piece 22 rotatably connected to the link portion 19*a.* A compression spring 23 urges the connecting piece 22 against a stop 24 at the lower end of the rod 21. The upper end of the rod 21 is pivotally connected at 25 to a telescopic connecting member 26 which comprises a tube 27 connected to the carrier arm 20 and a rod 28 freely displaceable in the tube to a stop 29 and connected to a lever 30 projecting downwardly from the back-rest 12 below its pivot axis 31.

The tube 27 has a row of locking teeth 27*a* which may be engaged by a locking member 27*b* to arrest the tube 27 and thus the leg support 14.

When the leg support 14 is moved from its vertical position shown in FIG. 1 up to its horizontal position shown in FIG. 2, the foot rest 15 will follow the path A which has a gradually increasing radius from the pivot center 16, so that the distance between the foot rest 15 and the pivot center 16 will be increased a distance B. If the radius between the pivot center 16 and the foot rest 15 would be constant, the foot rest would follow the circular path C.

The reason for extending the effective length of the leg support from the pivot center 16 in a manner known per se is that the knee-joint 32 between the under leg 33 and the upper leg 34 of the person sitting in the chair is located above and ahead of the pivot center 16 as will be understood from FIG. 1.

The spinal column 35 is pivotally connected to the upper leg 34 through the hip-joint 36.

The known chair under consideration and disclosed in the above U.S. patent includes a mechanism (not shown in FIG. 1) which results in that, when releasing the back-rest 12, it can be tilted backwards against the action of a spring such as a gas spring (not shown).

The back rest is connected to the leg support 14 by means of the telescopic connecting member 26 so that each leg support will be swung up towards its horizontal position and locked automatically when the back-rest is locked in its desired position. Upon this movement, the rod 28 abuts the stop 29 and displaces the tube 27 and thereby the carrier arm 20. If desired, the back-rest can thereafter be moved back towards its vertical position and locked in any desired position with the leg supports remaining in their locked position.

When leaning backwards and tilting the back rest to its horizontal position, the hip-joint 36 will be displaced backwards a distance D and the knee-joint 32 a corresponding distance E.

The known chair as disclosed in the above U.S. patent operates satisfactorily when constructed to suit a specific person having substantially a normal or average size and weight.

However, if the size and weight differ considerably from the normal or average values, the known chair will become more or less uncomfortable.

The general object of the invention is therefore to provide a chair under consideration, particularly a wheel-chair, which may be easily adjusted to persons of various sizes and weights.

One disadvantage of the known chair is that when a person is sitting in the chair and the length of the leg support in its vertical position has been adjusted and locked to a fixed length by means of the locking screw 17, the distance between the foot rest 15 in FIG. 2, that is the horizontal position of the leg support, and the pivot center 16 may be too short because the person sitting in the chair is small-sized and relatively thin. This means that the displacement D of the hip-joint 36 backwards will be less than for a normal-sized person. Accordingly, although the small-sized and thin person will sit comfortably in normal sitting position, his legs cannot be fully straightened out when in lying position with the back-rest and leg supports respectively in horizontal position.

One of the specific objects of the invention is therefore to provide simple adjustment means which makes it possible to eliminate this disadvantage.

A further object of the invention is to provide simple elastic means which in combination with the adjustment means according to the invention will compensate for that displacement of a leg on a horizontal leg support which occurs when the back-rest is tilted from its substantially horizontal position to its substantially vertical position. Upon this movement the hip-joint 36 and the knee-joint 32 as well as the foot 37 of the leg will be displaced forwardly a distance D and E respectively.

A still further object of the invention is to provide a simple locking device for the leg support.

The above and other objects of the invention are attained by a chair as defined in the claims.

Preferred embodiments of the chair according to the invention are shown in FIGS. 3 to 9 on the accompanying drawings.

Figure 1:
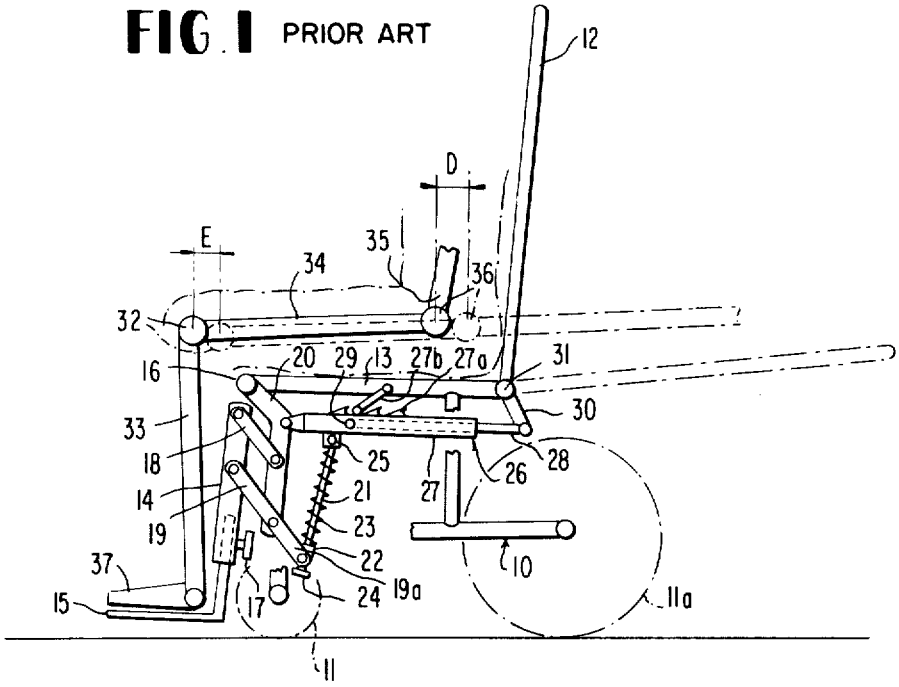
FIG. 1 PRIOR ART
FIGS. 1 and 2 illustrate the principles of a known chair as referred to above.
Figure 2:
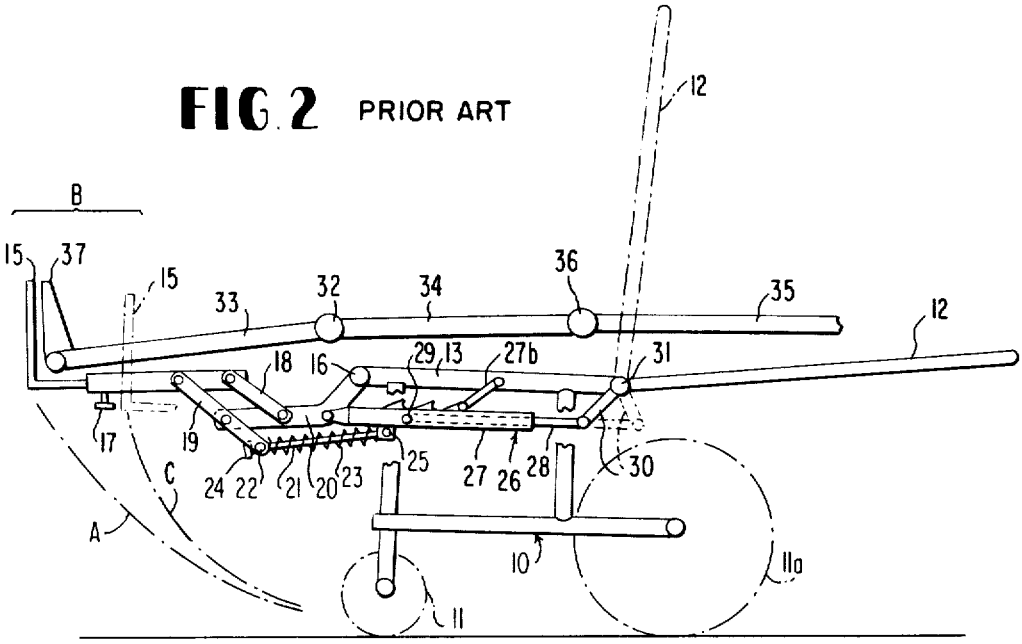
FIG. 2 PRIOR ART
Figure 3:
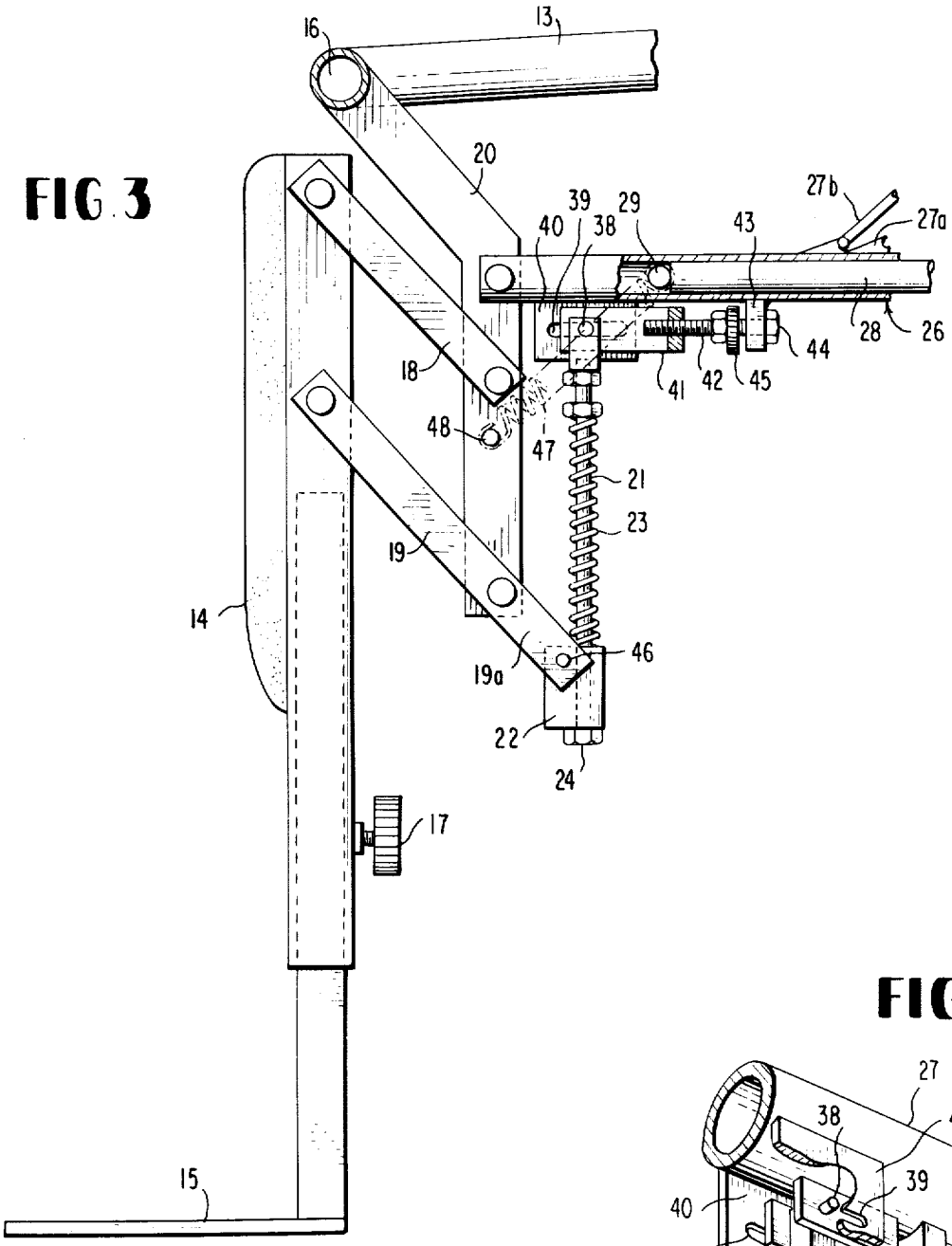
FIG. 3 is a diagrammatic partial elevational view of a leg support in its vertical position according to the invention.
Figure 4:
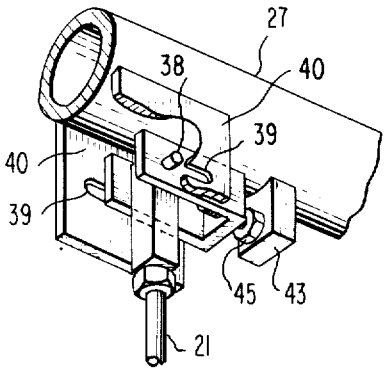
FIG. 4 is a diagrammatic perspective view of the adjustment device in FIG. 3.

The embodiment of the invention shown in FIG. 3 is constructed to a great extent substantially as the known chair shown in FIGS. 1 and 2 and explained above. Therefore, corresponding details shown in FIGS. 1 and 3 are denoted by the same reference numerals.

The basic difference between the leg supports in FIGS. 1 and 3 is that the leg support in FIG. 3 is provided with means for enabling a specific adjustment of the position of the upper pivot 38 of the connecting rod or link 21 relative to the carrier arm 20.

As will be seen from FIG. 3, the pivot 38 is a pin which is displaceable in slots 39 in two spaced brackets 40 secured to the tube 27. The pivot pin 38 is carried by a U-shaped member 41 which may be displaced along the tube 27 be means of an adjusting screw 42 rotatably mounted in a bracket 43 secured to the tube 27. A stop 44 and a control knob 45 are secured to the screw on opposite sides of the bracket 43 and prevent axial displacement of the screw. The screw is threaded through a threaded bore 46 in the cross member of the U-shaped member 41 so that rotation of the screw will effect axial displacement of the U-shaped member and thereby of the pivot pin 38.

The path provided by the two slots 39 or similar guiding means should substantially coincide with a circular path having its center at the lower pivot 46 of the connecting rod 21. Since the length of said path can be relatively short, the path can be in the form of a straight path since the deviation from the circular arc under consideration will not have any practical influence on the result desired. The straight path is easier to provide in manufacture and is for this reason to be preferred.

In FIG. 3 the leg support 14 is held in its vertical position by means of a tension spring 47 connecting the carrier arm 20 and the tube 27 between a pin 48 on the arm 20 and the stop member 29 on the tube 27.

Assuming that the chair has been used by a person of heavy weight and having long legs, and a relatively small-sized and thin person enters the chair in the position shown in FIG. 3, the first adjustment made is to shorten the length of the leg support 14 by loosening screw 17, raising the foot rest 15 to the desired position, and locking the screw 17.

Figure 5:
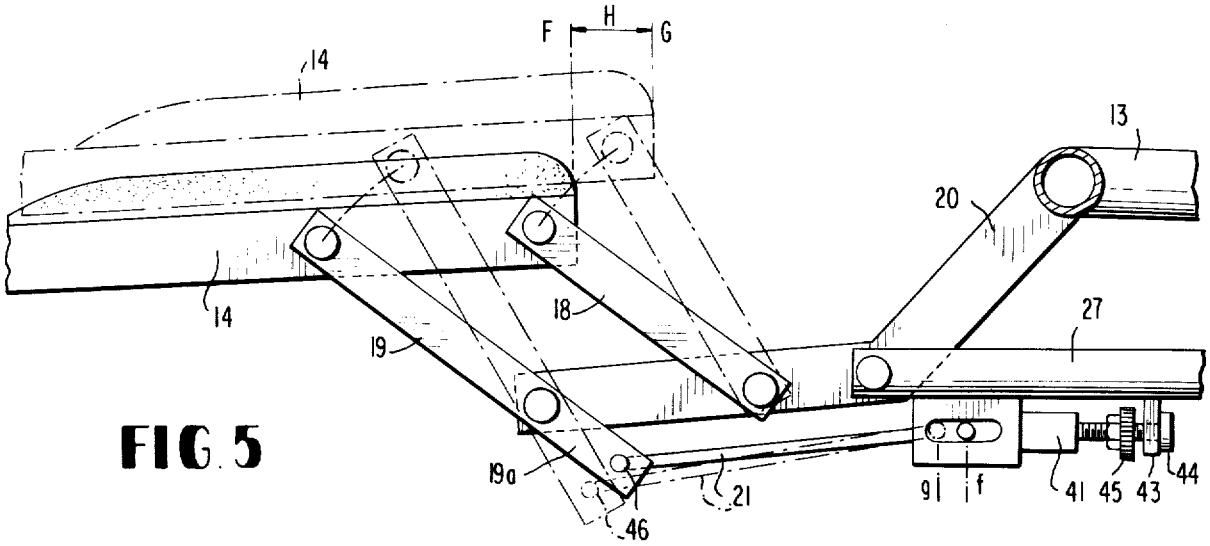
FIG. 5 is a view of the leg support in FIG. 3 moved to its substantially horizontal position.

If the leg support 14 is now swung upwards to its horizontal position by leaning backwards upon tilting the backrest 12 backwards to actuate the leg support through the rod 38, the stop 29 and the tube 27, the leg support 14 will take the horizontal position shown by solid lines in FIG. 5. The foot rest 15 will then be in a position which is too far away for the foot of the thin person sitting in the chair.

The reason for this is understood from FIGS. 1 and 2 where the forward position of the hip-joint 36, when the spinal column 35 is vertical, and the rearward position of the hip-joint 36, when the spinal column is horizontal, indicates that the hip-joint 36 as well as the knee-joint 32 and the foot 37 will be displaced backwards when the person is leaning backwards. If the person is stout, his hip-joint 36 will be located at a greater height above the sitting surface on the seat frame 13, and when the person is leaning backwards, this is a form of rolling movement which results in a displacement of the hip-joint 36 and the foot 37 respectively.

If the known chair in FIG. 1 has been designed to suit a stout or fat person, the mechanism supporting the leg support 14 has been selected to compensate for a relatively great displacement of hip-joint 36. Accordingly, a considerably smaller compensation will be required for a thin person having a smaller displacement of the hip joint when leaning backwards to a horizontal lying position.

The required adjustment is easily made in accordance with the invention. In the horizontal position of the leg support 14 shown by solid lines and referred to as position F, the adjustment screw 42 is rotated to displace the pivot pin 38 from the position *f* to the position *g*, which results in a corresponding displacement backwards H of the leg support 14 with its foot rest 15 from the position F to the position G. The displacement H places the foot rest 15 close to the foot 37 of the thin person lying in the chair as shown in FIG. 5.

However, this adjustment of the foot rest 15 in the lying position will not affect the basic adjustment of the leg support made in FIG. 3, that is settling the length of the leg support by means of the locking screw 17.

Figure 6:
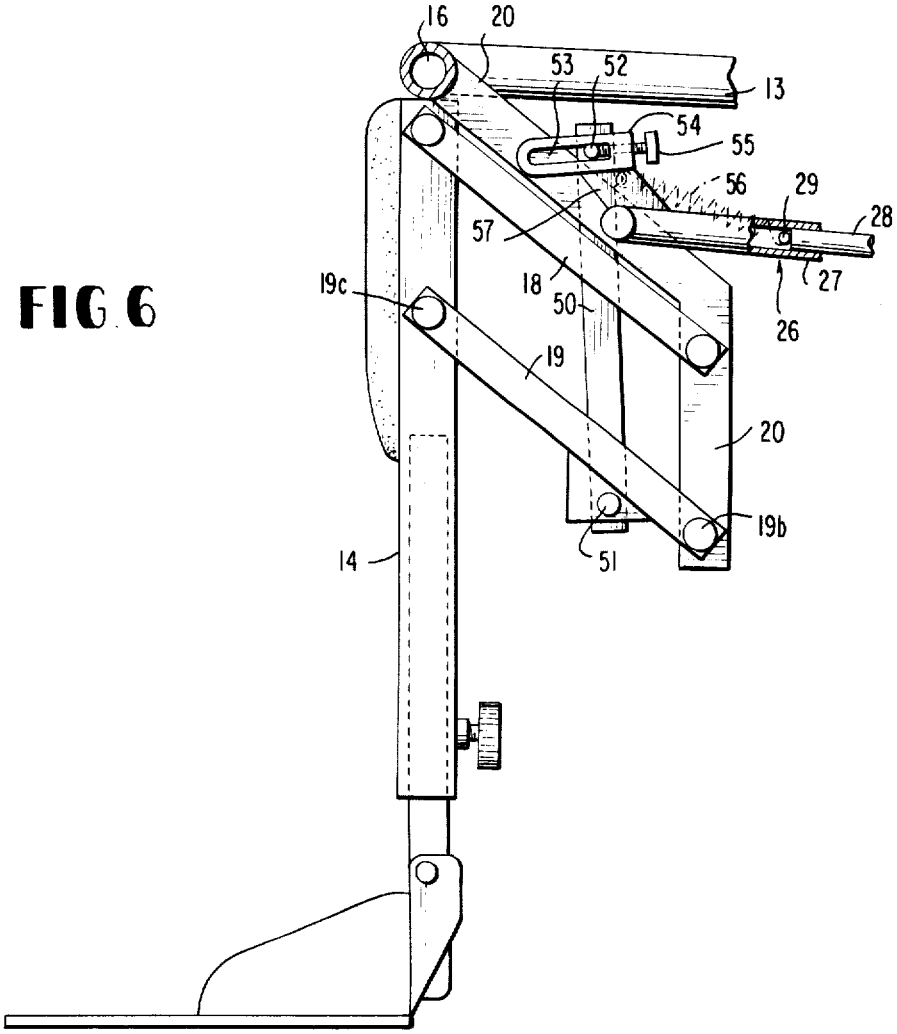
FIG. 6 is a partial elevational view of a modification of the leg support.

FIG. 6 shows a modification of the adjustment device in FIG. 3 to make the leg support still more comfortable.

In FIG. 6 the parallelogram linkage 18,19 and carrier arm 20 for carrying the leg support 14 is substantially the same as in FIGS. 1 and 3, whereas the connecting rod 50 has its lower pivot 51 connected to the link 19 in a position between its pivot connection 19*b* to the carrier arm 20 and its pivot connection 19*c* to the leg support.

In the vertical position of the leg support 14 in FIG. 6 the connecting rod is substantially parallel with the leg support 14 and has its upper pivot pin 52 displaceable in a slot 53 in a member 54 carried by an arm 57 secured to the tube 27.

The slot 53 is located substantially along a circular arc having its center at the lower pivot pin 51 of the rod or link 50.

In contrast to the embodiment in FIG. 3, the pivot pin 52 is freely displaceable between two end positions, one of which is formed by the end of an adjustment screw 55 rotatable in a threaded bore in the member 54. The pivot pin 52 is normally held in its end position against the end of the screw 55, as shown in FIG. 6, by means of a tension spring 56 connected to the tube 27 at the stop 29 and at a point on the rod or link 50 so that the link 50 will be held in the position shown in FIG. 6 when the leg support 14 is vertical.

If the back-rest is tilted backwards to its horizontal position so that the leg support will sumultaneously be swung to its horizontal position, as shown by solid lines in FIG. 8, the adjusting screw 55 may be operated to adjust the position of the lying person, as explained in connection with FIG. 5, although the movement of the screw is opposite in FIG. 8, that is displacement of the pivot pin 52 in FIG. 8 will, towards the leg support, lengthen the leg support in its horizontal position, whereas the same displacement of the pin 38 in FIG. 5 will shorten the length of the leg support.

Figure 8:
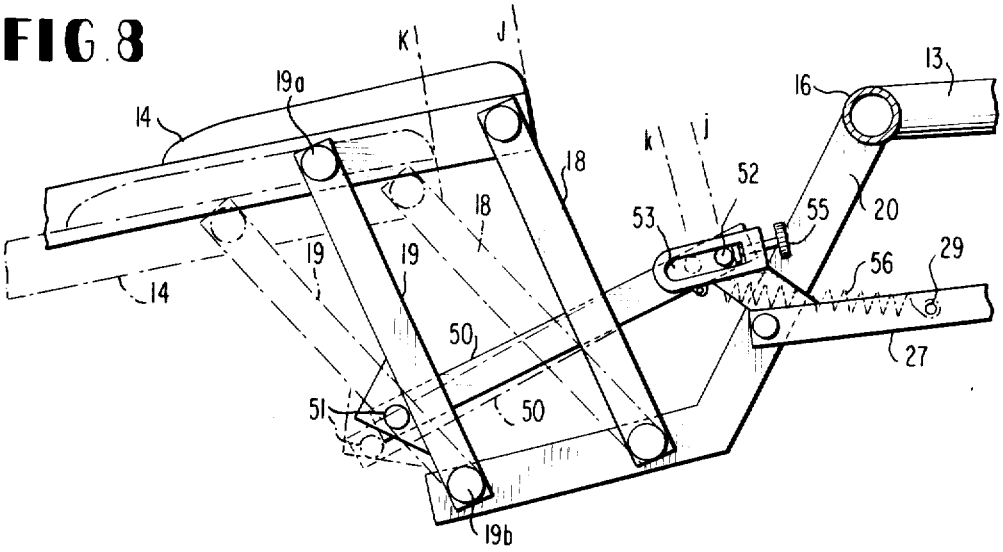
FIG. 8 shows the leg support in FIG. 6 when moved to a slightly oblique or substantially horizontal position.

Reverting to FIG. 8 it is assumed that the length of the leg support 14 in its horizontal position has been adjusted to the actual person lying in the chair, the pin 54 is in position *j* and the leg support is in position J.

If now the lying person would rise to a sitting position in which he desires to maintain his leg in a horizontal position, this can simply be attained by releasing the backrest 12 so that its gas-spring (not shown) in a known manner raises the back-rest to its vertical position. The leg support is locked as described in connection with FIGS. 1 and 3 by means of member 27*b* and teeth 27*a*.

In FIGS. 2 and 5 the distance between the foot rest 15 and the pivot center has been adjusted to a fixed position, that is a predetermined length suitable for a lying person. However, when the lying person rises to sitting position with the leg maintained in horizontal position, the hip-joint 36 as shown in FIGS. 1 and 2 will be displaced from its rearward to its forward position, but since the foot rest 15 is held stationary there will be no easy possibility to displace the foot corresponding to the displacement of the hip-joint. In the known chair and in FIG. 5 the leg must accordingly be folded at the knee-joint which results in an uncomfortable position of the leg.

Figure 7:
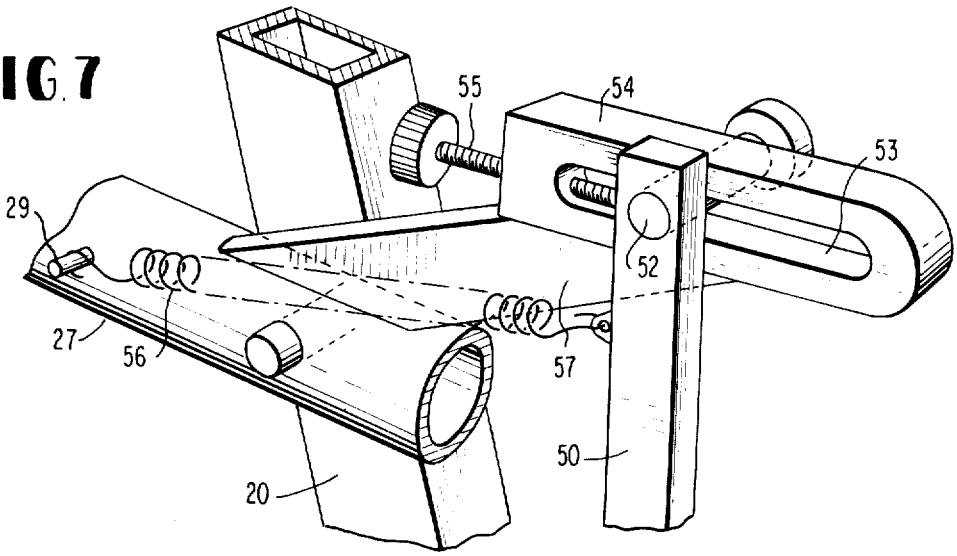
FIG. 7 is a diagrammatic perspective detail view of the adjustment device in FIG. 6.

This drawback is eliminated in the embodiment of FIGS. 6 to 8 since, as shown in FIG. 8, the pivot pin 52 may be displaced forwards in the slot to position *k*, or any other position ahead of position *j*, against the action of the tension spring 56. The tension spring 56 is relatively weak or not much stronger than is required to hold the pin 52 in its position against the end of the screw 55 under normal position.

Accordingly, only a rather slight pressure on the foot rest 15 in the horizontal position of the leg support will result in that the pin *j* is moved to position *k* and the leg support 14 and its foot rest 15 is displaced to position K where the leg has been straightened out and rests normally on the horizontal leg support also when the back-rest is in its vertical position.

Figure 9:
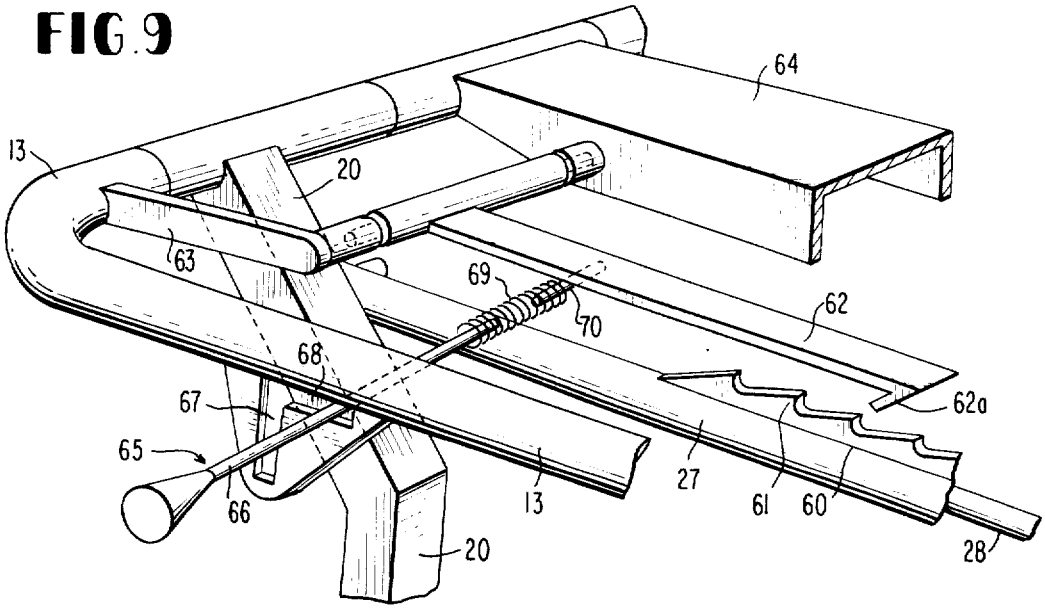
FIG. 9 is a diagrammatic perspective view of a preferred embodiment of a mechanism for locking or releasing, respectively, the leg support in FIGS. 3 to 8.

The leg support 14 can be locked in any desired angular position or in its horizontal position by means of the simple and effective mechanism illustrated in FIG. 9.

The tube 27 has secured thereto a member 60 provided with a row of locking teeth 61.

A locking arm 62 is at its forward end pivotally mounted between a bracket 63 and a section 64 secured to the seat frame 13.

A control rod 65 comprises an outer portion 66 and an inner portion 70 which are connected merely by a helical spring 69 so that the outer rod portion 66 may resiliently be bent to angular positions relative to the inner rod portion 70.

The outer rod portion 66 is guided in a guide slot having a vertical slot portion 67 which at its upper end merges into a substantially horizontal groove portion 68.

In FIG. 9 the outer rod portion 66 is located in its upper position, that is in the horizontal groove portion 68. In this position the locking arm is held in its upper free position, in which the hook 62*a* at the end of the arm 62 is located freely above the teeth 61.

If the leg support is to be swung from its vertical position to any desired angular position or its horizontal position, the arm 62 is lowered so that its hook end 62*a* engages the teeth 61. This is done by shifting the outer rod portion 66 to be positioned in the vertical groove portion 67. The leg support will thus be locked in the desired position.

If now the person sitting in the chair will release the leg support and lower it to its vertical position, this is easily done by first shifting the outer rod portion 66 to the horizontal guide groove portion 68. Since the hook 62*a* is in engagement with one of the teeth, the arm 62 will not be moved upwardly but remain in its locked position, and therefore the outer rod portion will be set in an angular position with the spring 69 bent to a certain degree. If now the back-rest is released and tilted slightly backwards, the tube 27 and the teeth 61 will be moved forwards, which means that the hook 62*a* is released from the respective tooth 61, and the prestressed spring 69 is straightened out and raises the arm 62 to its free position. The leg support will now follow the movements of the back-rest, and if the back-rest is moved to its upright position, the leg support will be moved to its desired vertical position. The control rod 65 thus enables the person to manage himself in a simple manner to shift the leg support to any desired position.

What I claim is:

1. In a chair having a frame and provided with a resiliently tiltable back-rest frame, a seat frame and two separate leg supporting means arranged at the front end of the seat frame so as to support the legs of a person sitting in the chair, each leg supporting means including an adjustable foot rest and being capable to be swung about a pivot center on the frame at the front end of the seat frame from a substantially vertical position in which the foot rest is in a lower position adjacent the floor or ground to support the respective foot of the person, to a substantially horizontal leg supporting position, each of the supporting means in its vertical position being carried by a parallelogram linkage system movable in a longitudinal vertical plane and including a lower and an upper pivot point on the leg supporting means, a lower and an upper pivot point on a carrier arm located behind the leg supporting means and having an upper end pivotally mounted to the frame at the front end of the seat, an upper link arm connecting the two upper pivot points and a second lower link arm connecting the two lower pivot points, the parallelogram linkage being operative in response to swinging of the carrier arm forwards from its initial position to move the leg supporting means away from its pivot center on the frame to increase the distance between the foot rest and the pivot center, said movement of the parallelogram linkage being controlled by a connecting rod or link having its lower pivot point on the lower parallelogram link and its other pivot point on a telescopic connecting rod connecting the carrier member with a lever arm secured to the back-rest and extending below its pivot axis, said connecting rod or link having a substantially vertical position when the leg supporting means is vertical; the improvement comprising a guide member secured to one part of said telescopic connecting member and guiding said upper pivot of the connecting rod or link along a path substantially coinciding with a circular arc having its center at the lower pivot of the connecting rod at its connection with the lower parallelogram link.

2. A chair as defined in claim 1, characterized in that the displaceable upper pivot is movable between a rear end position and a forward end position in said guide, and that it is held at the rear end position under the influence of a spring but may be displaced against the action of the spring, and that the lower pivot is connected to the lower parallelogram link in a position between its ends.

3. A chair as defined in claim 1, characterized in that the part of the telescopic connecting member connected to the carrier arm is provided with a row of upwardly projecting locking teeth, that a longitudinal locking arm is pivotally mounted at its forward end and has at its rear end a hook adapted to engage the locking teeth, that the locking arm is held in its free upper position by a resilient control rod extending transversely outside the chair and which, with its outer position, may be set in upper position or may be shifted to a guide permitting the locking arm to move freely so that, when the locking hook engages a locking tooth, the control rod may be prestressed by moving it to its upper locked position which will release the hook when the telescopic connecting member connected to the carrier arm is moved rearwardly.

* * * * *